US007722510B2

(12) United States Patent
Jhu

(10) Patent No.: US 7,722,510 B2
(45) Date of Patent: May 25, 2010

(54) TWO-SECTION PHYSICAL-EXERCISE ELASTIC CUDGEL

(76) Inventor: Jheng-Gang Jhu, No. 240, Niupu S. Rd., Shiangshan District, Hsinchu City 300 (TW)

( * ) Notice: Subject to any disclaimer, the term of this patent is extended or adjusted under 35 U.S.C. 154(b) by 0 days.

(21) Appl. No.: 12/379,626

(22) Filed: Feb. 26, 2009

(65) Prior Publication Data

US 2009/0215592 A1 Aug. 27, 2009

(30) Foreign Application Priority Data

Feb. 26, 2008 (TW) ..... 97203307 U

(51) Int. Cl.
*A63B 21/02* (2006.01)
*A63B 21/072* (2006.01)

(52) U.S. Cl. ..... 482/106; 482/110; 482/131

(58) Field of Classification Search ..... 482/92–94, 482/44, 50, 106–110, 126, 127, 131; 84/477 B
See application file for complete search history.

(56) References Cited

U.S. PATENT DOCUMENTS

| | | | | |
|---|---|---|---|---|
| 405,128 | A * | 6/1889 | Stockburger | 482/106 |
| 1,714,391 | A * | 5/1929 | McWhirter | 482/148 |
| 4,664,373 | A * | 5/1987 | Hait | 482/93 |
| 4,682,774 | A * | 7/1987 | Holy | 463/47.5 |
| 4,712,792 | A * | 12/1987 | Rogall | 482/23 |
| 4,964,633 | A * | 10/1990 | Hymanson | 482/110 |
| 5,147,262 | A * | 9/1992 | Hymanson | 482/110 |
| 5,393,284 | A * | 2/1995 | Wesley | 482/106 |
| 5,536,227 | A * | 7/1996 | Polchek et al. | 482/93 |
| 5,891,003 | A * | 4/1999 | Deac et al. | 482/106 |
| 6,217,495 | B1 * | 4/2001 | Yalch | 482/109 |
| 6,280,364 | B1 * | 8/2001 | Deac et al. | 482/106 |
| 6,293,893 | B1 * | 9/2001 | Truchelut | 482/121 |
| 6,872,174 | B2 * | 3/2005 | Benach | 482/121 |
| D517,135 | S * | 3/2006 | Klein | D21/679 |
| D556,841 | S * | 12/2007 | Oates | D21/679 |
| 7,591,772 | B2 * | 9/2009 | Shillington | 482/107 |

(Continued)

FOREIGN PATENT DOCUMENTS

CN 201186125 Y * 1/2009

(Continued)

*Primary Examiner*—Loan H Thanh
*Assistant Examiner*—Victor K Hwang
(74) *Attorney, Agent, or Firm*—Rosenberg, Klein & Lee

(57) ABSTRACT

A two-section physical-exercise elastic cudgel comprises a first carbon-fiber rod and a second carbon-fiber rod. The first carbon-fiber rod has a rod body, a first joint end with a first handle structure, and a first balance-weight end with a balance weight. The first handle structure has a handlebar, a male connection block, a supporter and a sleeve ring. The second carbon-fiber rod has a rod body, a second joint end with a second handle structure, and a second balance-weight end with a balance weight. The second handle structure has a handlebar, a female connection block, a supporter and a sleeve ring. The first handle structure is connected with the second handle structure via engagement of the male connection block and the female connection block to form a complete handle, whereby the first carbon-fiber rod and the second carbon-fiber rod form an easy-to-assemble, easy-to-disassemble, easy-to-carry and easy-to-collect two-section physical-exercise elastic cudgel.

4 Claims, 4 Drawing Sheets

U.S. PATENT DOCUMENTS

| | | | | |
|---|---|---|---|---|
| 2002/0155933 | A1 * | 10/2002 | Chen | 482/148 |
| 2007/0135275 | A1 * | 6/2007 | Oates | 482/109 |
| 2009/0215592 | A1 * | 8/2009 | Jhu | 482/110 |
| 2009/0233772 | A1 * | 9/2009 | Eck | 482/106 |

FOREIGN PATENT DOCUMENTS

| | | | |
|---|---|---|---|
| CN | 201304198 | Y * | 9/2009 |
| DE | 10125215 | A1 * | 1/2003 |
| DE | 202007008017 | U1 * | 12/2007 |
| DE | 202009004912 | U1 * | 11/2009 |
| FR | 2591496 | A1 * | 6/1987 |
| WO | WO 9309850 | A1 * | 5/1993 |

* cited by examiner

TWO-SECTION PHYSICAL-EXERCISE ELASTIC CUDGEL

BACKGROUND OF THE INVENTION

1. Field of the Invention

The present invention relates to a physical-exercise elastic cudgel, particularly to an easy-to-carry and easy-to-collect two-section physical-exercise elastic cudgel.

2. Description of the Related Art

The conventional physical-exercise elastic cudgel is used to vibrate away fatness, perform various physical exercises, or function as the toss rod of the Chinese martial art.

Refer to FIG. 4. The conventional physical-exercise elastic cudgel is a carbon-fiber rod 70 with a handle 71 at the middle and two balance weights 72 and 73 at two ends. The user holds the handle 71 and moves the elastic cudgel up and down repeatedly to induce the vibration of the elastic cudgel. The vibration will feed back to the user's body to generate effects of exercise, fitness and weight reduction.

However, the conventional physical-exercise elastic cudgel is an integral body and unlikely to disassemble. Then, the conventional physical-exercise elastic cudgel always has a considerable length, which makes it hard to package, transport, store, and exhibit for the manufacturers and the sellers, and which also makes it hard to carry and collect for the users. Thus, the user can only use the conventional physical-exercise elastic cudgel at a specified location, which greatly reduces the utility of the conventional physical-exercise elastic cudgel. Therefore, the conventional physical-exercise elastic cudgel has room to improve.

SUMMARY OF THE INVENTION

As the conventional physical-exercise elastic cudgel is hard to package, transport, store, exhibit, carry and collect, the present invention propose a two-section physical-exercise elastic cudgel to solve the abovementioned problems.

The present invention discloses a two-section physical-exercise elastic cudgel comprising a first carbon-fiber rod and a second carbon-fiber rod. The first carbon-fiber rod has a rod body, a first joint end and a first balance-weight end. The first balance-weight end has a balance weight, and the first joint end has a first handle structure. The first handle structure has a handlebar, a male connection block, a supporter and a sleeve ring. The handlebar has a recess, inside which the supporter, the sleeve ring, and the male connection block are sequentially installed.

The second carbon-fiber rod has a rod body, a second joint end and a second balance-weight end. The second balance-weight end has a balance weight, and the second joint end has a second handle structure. The second handle structure has a handlebar, a female connection block, a supporter and a sleeve ring. The handlebar has a recess, inside which the supporter, the sleeve ring, and the female connection block are sequentially installed.

The first handle structure is connected with the second handle structure via the engagement of the male connection block and the female connection block to form a complete handle, whereby the first carbon-fiber rod and the second carbon-fiber rod form an easy-to-assemble, easy-to-disassemble, easy-to-carry and easy-to-collect two-section physical-exercise elastic cudgel.

The supporter of the first handle structure has at least one through-slot, and the supporter of the second handle structure also has at least one through-slot.

The male connection block has an external thread, and the female connection block has an inner thread corresponding to the external thread. The first handle structure is connected with the second handle structure via the engagement of the external thread and the inner thread to form a complete handle.

Compared with the conventional technology, the present invention has a dismountable two-section design, wherein the first handle structure and the second handle structure are used to form a complete handle, whereby the first carbon-fiber rod and the second carbon-fiber rod are assembled together to form an easy-to-assemble, easy-to-disassemble, easy-to-carry and easy-to-collect two-section physical-exercise elastic cudgel, wherefore is effectively solved the problems caused by too great a length of the conventional physical-exercise elastic cudgel.

Below, the embodiments are described in detail in cooperation with the drawings to make easily understood the objectives, technical contents, characteristics and accomplishments of the present invention.

DETAILED DESCRIPTION OF THE INVENTION

Figure 1:
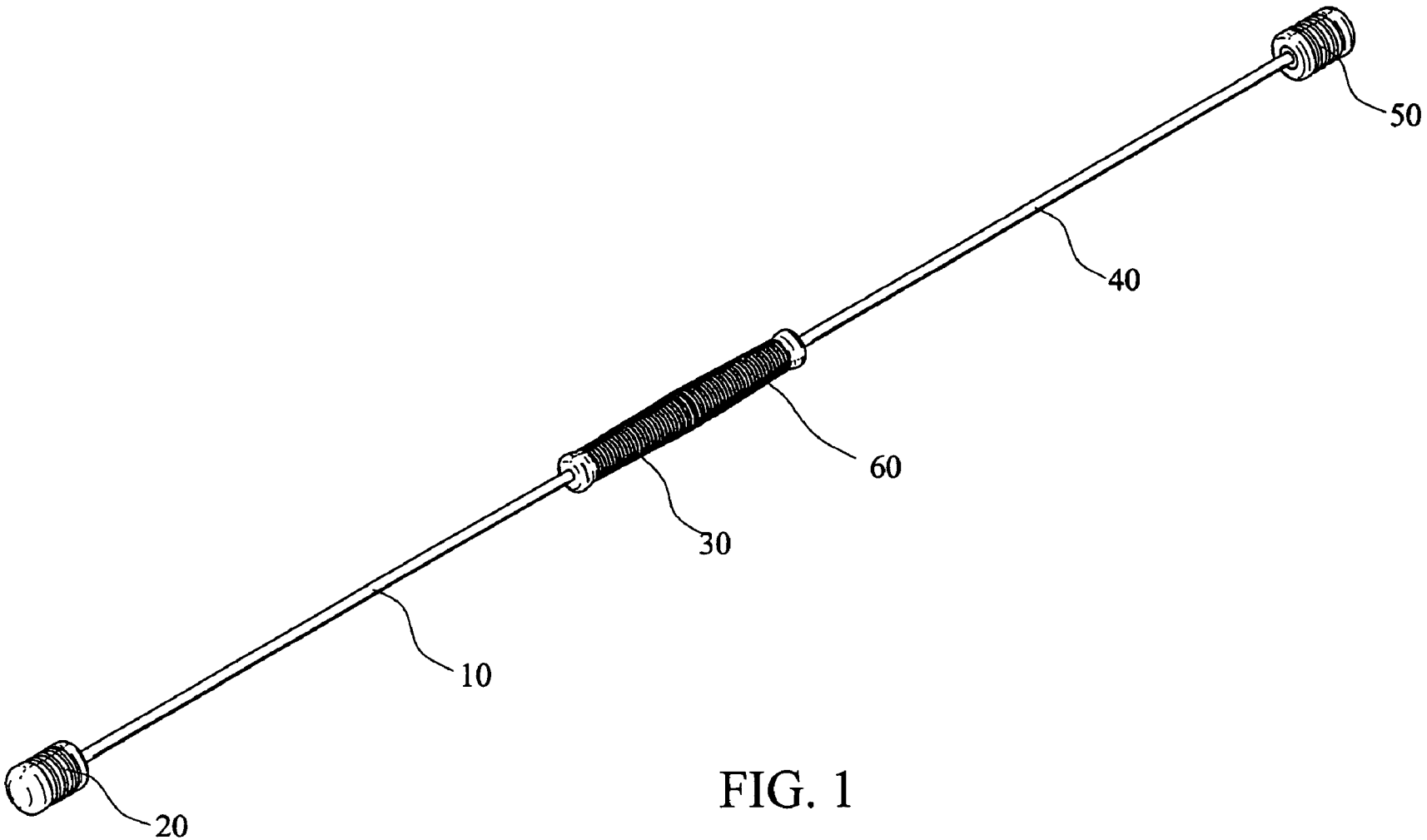
FIG. 1 is a perspective view schematically showing a two-section physical-exercise elastic cudgel according to one embodiment of the present invention.
Figure 2:
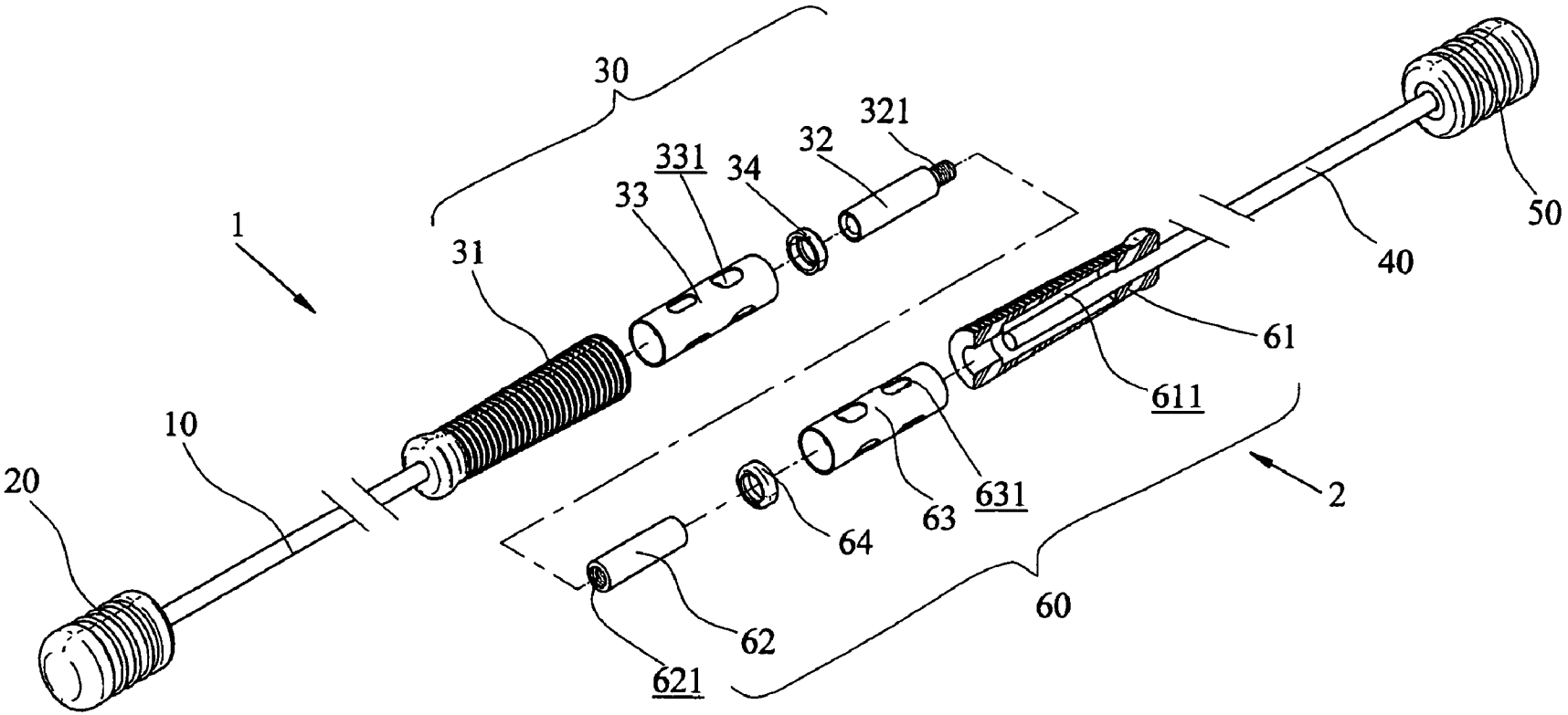
FIG. 2 is an exploded view schematically showing a two-section physical-exercise elastic cudgel according to one embodiment of the present invention.
Figure 3:
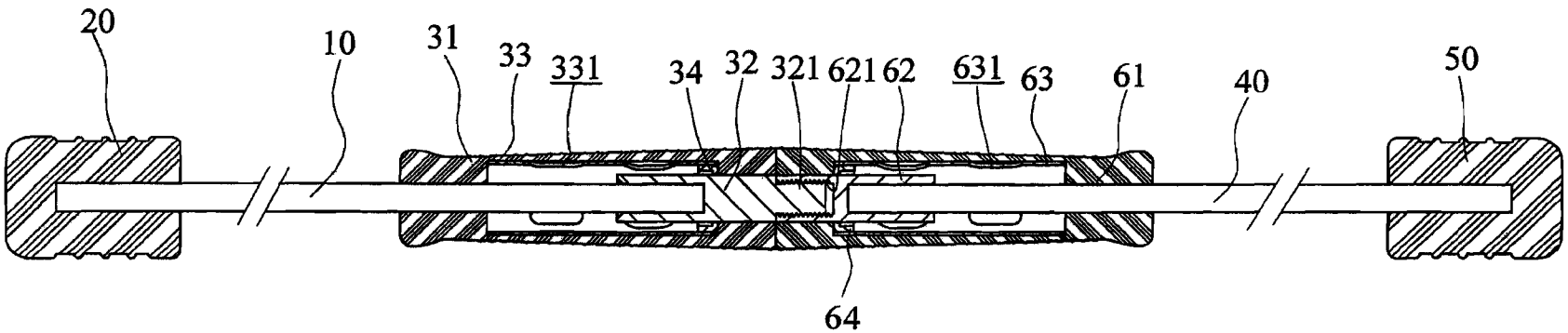
FIG. 3 is a sectional view schematically showing a two-section physical-exercise elastic cudgel according to one embodiment of the present invention.
Figure 4:
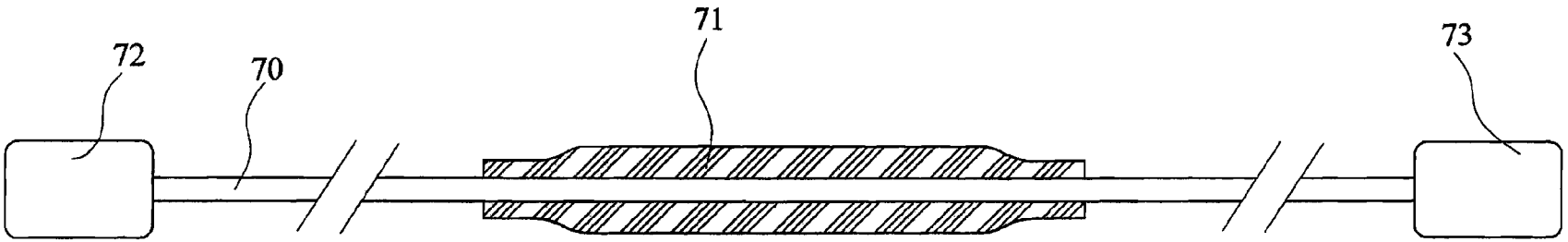
FIG. 4 (Prior Art)
FIG. 4 is a perspective view schematically showing a conventional physical-exercise elastic cudgel.

Refer to FIGS. 1-3. The present invention provides a two-section physical-exercise elastic cudgel, which comprises a first carbon-fiber rod 1 and a second carbon-fiber rod 2. The first carbon-fiber rod 1 has a rod body 10, a first joint end and a first balance-weight end. The first balance-weight end has a balance weight 20, and the first joint end has a first handle structure 30. The first handle structure 30 has a handlebar 31, a male connection block 32, a supporter 33 and a sleeve ring 34. The supporter 33 is a hollow pipe having at least one through-slot 331 that can reduce weight and save material. The handlebar 31 has a recess, inside which the supporter 33, the sleeve ring 34, and the male connection block 32 are sequentially installed. The supporter 33 is used to enhance the strength of the first handle structure 30.

The second carbon-fiber rod 2 has a rod body 40, a second joint end and a second balance-weight end. The second balance-weight end has a balance weight 50, and the second joint end has a second handle structure 60. The second handle structure 60 has a handlebar 61, a female connection block 62, a supporter 63 and a sleeve ring 64. The supporter 63 is a hollow pipe having at least one through-slot 631 that can reduce weight and save material. The handlebar 61 has a recess 611, inside which the supporter 63, the sleeve ring 64, and the female connection block 62 are sequentially installed. The supporter 63 is used to enhance the strength of the second handle structure 60.

Via the engagement of the male connection block 32 and the female connection block 62, the first handle structure 30 and the second handle structure 60 form a complete handle, and the first carbon-fiber rod 1 and the second carbon-fiber rod 2 form an easy-to-assemble, easy-to-disassemble, easy-to-carry and easy-to-collect two-section physical-exercise elastic cudgel. The male connection block 32 has an external thread 321, and the female connection block 62 has an inner thread 621 corresponding to the external thread 321. The first handle structure 30 and the second handle structure 60 are connected to form a complete handle via the engagement of the external thread 321 and the inner thread 621.

In conclusion, the present invention has a dismountable two-section design, wherein the first handle structure and the second handle structure are used to form a complete handle, whereby the first carbon-fiber rod and the second carbon-fiber rod are joined to form an easy-to-assemble, easy-to-disassemble, easy-to-carry and easy-to-collect two-section physical-exercise elastic cudgel, wherefore is effectively solved the problems caused by too great a length of the conventional physical-exercise elastic cudgel.

The embodiments described are only to exemplify the present invention but not to limit the scope of the present invention. Any equivalent modification or variation according to the scope of the present invention is to be also included within the scope of the present invention.

What is claimed is:

1. A two-section physical-exercise elastic cudgel comprising a first carbon-fiber rod having a rod body, a first joint end and a first balance-weight end, wherein said first balance-weight end has a balance weight, and said first joint end has a first handle structure, and wherein said first handle structure has a first handlebar, a male connection block, a first supporter and a first sleeve ring, and wherein said first handlebar has a first recess, inside which said first supporter, said first sleeve ring and said male connection block are sequentially installed; and a second carbon-fiber rod having a rod body, a second joint end and a second balance-weight end, wherein said second balance-weight end has a balance weight, and said second joint end has a second handle structure, and wherein said second handle structure has a second handlebar, a female connection block, a second supporter and a second sleeve ring, and wherein said second handlebar has a second recess, inside which said second supporter, said second sleeve ring and said female connection block are sequentially installed, and wherein said first handle structure and is connected with said second handle structure via engagement of said male connection block and said female connection block to form a complete handle, whereby said first carbon-fiber rod and said second carbon-fiber rod form an easy-to-assemble, easy-to-disassemble, easy-to-carry and easy-to-collect two-section physical-exercise elastic cudgel.

2. The two-section physical-exercise elastic cudgel according to claim 1, wherein said first supporter of said first handle structure has at least one through-slot.

3. The two-section physical-exercise elastic cudgel according to claim 1, wherein said second supporter of said second handle structure has at least one through-slot.

4. The two-section physical-exercise elastic cudgel according to claim 1, wherein said male connection block has an external thread, and said female connection block has an inner thread corresponding to said external thread; said first handle structure is connected with said second handle structure via engagement of said external thread and said inner thread to form a complete handle.

* * * * *